United States Patent [19]

Perkins, Jr.

[11] Patent Number: 4,799,906

[45] Date of Patent: Jan. 24, 1989

[54] RESCUE APPARATUS

[75] Inventor: Benjamin F. Perkins, Jr., Holyoke, Mass.

[73] Assignee: Technical Equipment Associates of Florida, Inc., Palm Beach, Fla.

[21] Appl. No.: 126,401

[22] Filed: Nov. 30, 1987

[51] Int. Cl.[4] ..... B63C 9/26

[52] U.S. Cl. ..... 441/85; 89/1.34; 102/504; 441/92

[58] Field of Search ..... 441/80, 84, 85, 92, 441/93, 94, 95; 102/501, 504; 89/1.34

[56] References Cited

U.S. PATENT DOCUMENTS 2,069,276 2/1937 Ryan ..... 102/504

2,952,091 9/1960 Blanchard ..... 102/504 X 3,505,926 4/1970 Johnson ..... 102/504 X

*Primary Examiner*—Sherman D. Basinger

*Attorney, Agent, or Firm*—Ross, Ross & Flavin

[57] ABSTRACT

Rescue apparatus comprising, a launcher, a missile and a supply of line mounted on the launcher, the launcher comprising a non-lethal firearm adapted to fire a blank round and having a barrel with a bore closed at its muzzle end, the muzzle end having gas ports therein, the missile being sleevable on the barrel and having means for connecting the line thereto, whereby when the firearm is discharged, gas escapes from the bore through the gas ports to propel the missile into space, carrying the line therewith.

3 Claims, 5 Drawing Sheets

RESCUE APPARATUS

BACKGROUND OF THE INVENTION

1. Field of the Invention

The invention relates to rescue apparatus and more particularly to such apparatus as may be propelled through 2. Description of Related Art Devices are known for propelling a line or buoys or the like. However, same have been unreliable and many are dangerous in that they are fired from the bore of a rifle or similar device much in the manner of a bullet and may cause harm or damage if persons or property are struck.

SUMMARY OF THE INVENTION

The invention offers rescue apparatus comprising a safe, simple, inexpensive launcher, missiles and line for rescue operations over water, terrain or in buildings.

DESCRIPTION OF THE PREFERRED EMBODIMENT

Figure 1:
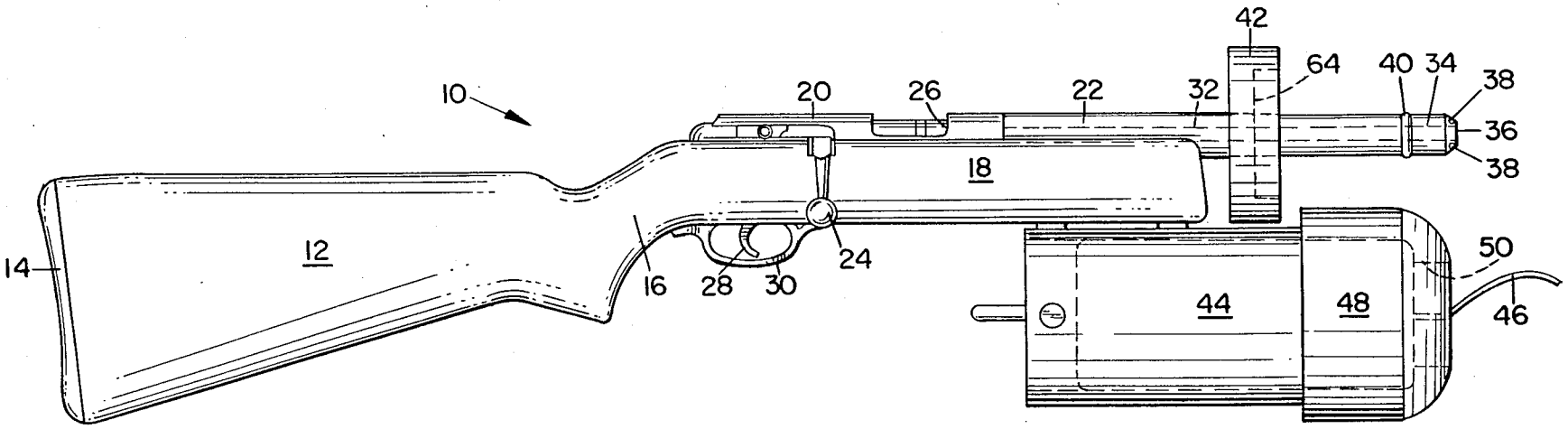
FIG. 1 is a front elevational view of the launcher of the rescue apparatus of the invention, with the bolt thereof shown in a closed position.
Figure 2:
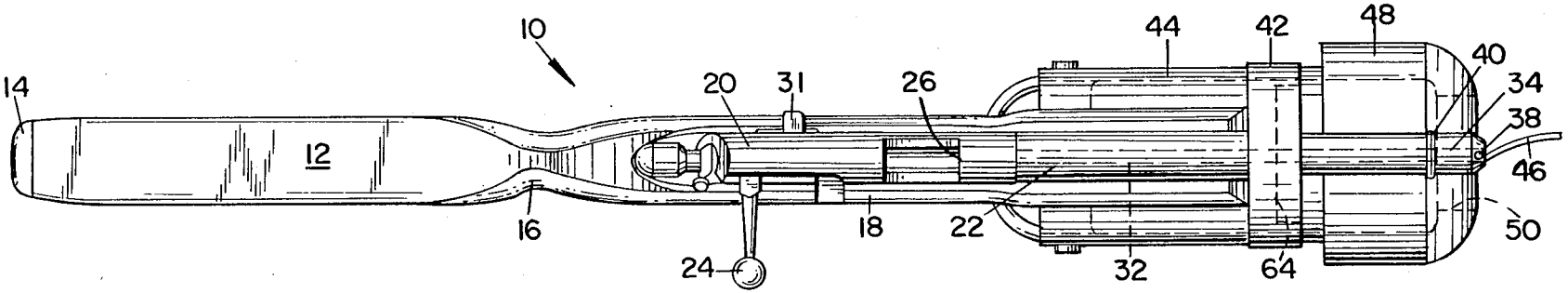
FIG. 2 is a top plan view of the launcher, with the bolt thereof shown in an opened position.
Figure 3:
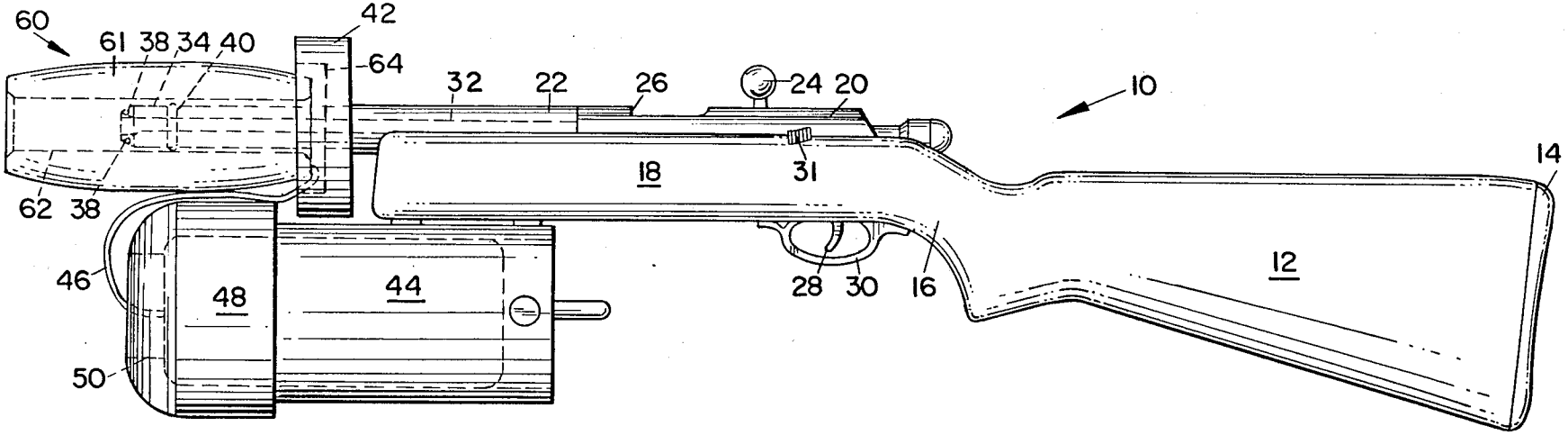
FIG. 3 is a rear elevational view of the launcher, with the bolt thereof shown in an opened position and having a missile in the form of a buoy in place ready to be launched.

The launcher of the rescue apparatus of the invention is generally indicated by 10 and includes a shoulder stock of standard construction having a butt 14 and a hand grip 16 which merges with a bed 18 which supports a breech and a barrel 22, all similar to a conventional firearm. A bolt 24 of usual construction is movable relative to the breech to selectively open and close a chamber 26 adapted to receive such as a blank .22 caliber shell, not A trigger 28 enclosed by a guard 30 may be depressed to fire the shell.

A conventional safety 31 is provided to preclude accidental firing, all in known manner.

Figure 5:
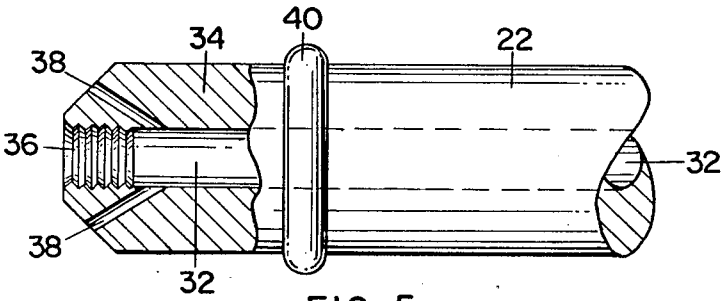
FIG. 5 is an enlarged, fragmentary part-sectional view of the launcher muzzle.

Barrel 22 has a bore 32 which extends the length thereof, terminating at a muzzle 34 closed by a plug 36, best seen in FIG. 5, threadedly engaged in the bore. In lieu of plug 36, bore 32 may terminate inwardly of the muzzle end to provide a blind end to the bore.

A plurality of circumferentially arranged gas ports 38 of restricted diameter extend radially into muzzle.34 and communicate at their inner ends with bore 32.

An O-ring 40 circumscribes muzzle 34 immediately rearwardly of ports 38, and an annular bracket 42 is fixed to and circumscribes barrel 22 immediately rearwardly of O-ring 40, all for purposes to appear.

A tubelike container 44 houses a supply of coiled line or cord 46 and is fixed to and depends from the lower face of bed 18 adjacent the forward end of the latter so as to be disposed immediately below bracket 42 in spaced parallelism to barrel 22.

An annular cap 48 is sleeved on the forward end of container 44 and has a central aperture 50 therein through which line 46 passes.

Launcher 10 is adapted to launch or propel lifesaving aids such as missiles in the form of a buoy, generally indicated by 60, or in the form of an article carrier, generally indicated by 70.

Figure 7:
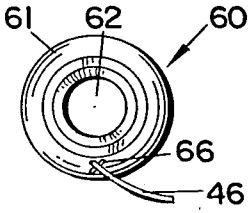
FIG. 7 is an end elevational view of the buoy of FIG. 6.
Figure 6:
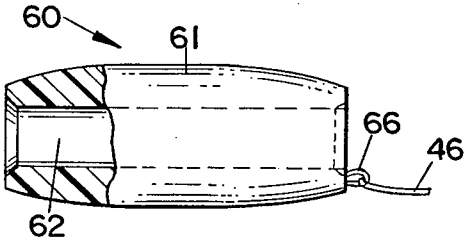
FIG. 6 is a top plan view of the buoy of FIG. 3 with parts broken away for clarity.
Figure 4:
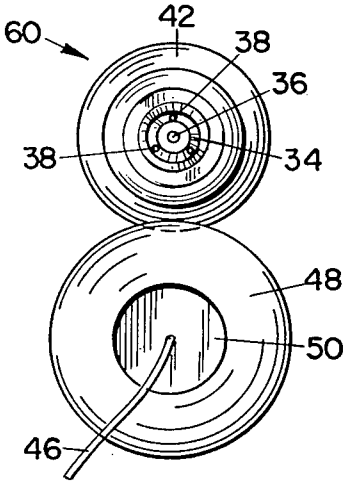
FIG. 4 is an end elevational view of the launcher, as seen from the right of FIG. 1.

Buoy 60, which is fabricated from a lightweight, floatable material such as plastic or cork, is best seen in FIGS. 6 and 7 and has a somewhat elliptically shaped body 61 with an annular central bore 62 which passes longitudinally therethrough.

Buoy 60 is of such size, shape and weight as to be throwable by hand or to be launchable by launcher 10.

Bore 62 of buoy 60 is of appropriate size as to be slidably receivable over the muzzle 34 and barrel 22 of launcher 10 and to snugly embrace O-ring 40

The rearward end of body 61 of buoy 60 is receivable in a central annular cavity 64 provided in the forwardly-facing face of bracket 42 on launcher barrel 22.

A ring or clip 66 is provided on the rearward end of body 61 and has the outer free end of line or cord 46 secured thereto.

When launcher 10 is discharged upon depression of trigger 28 to fire a blank cartridge, gases released through ports 38 in the muzzle of barrel 22 propel buoy 60 into space to any target at which the launcher is aimed. After buoy 60 reaches its' target, line 46 may be cut.

Article carrier 70, best seen in FIGS. 8–16, is of appropriate configuration, size and weight as to be throwable by hand or to be projectable or launchable by launcher 10.

Article carrier 70 includes a trough-like, horizontally disposed body 72 which is semi-circular in transverse cross-section and is preferably fabricated from lightweight metal or plastic.

A pair of spaced, parallel, upright forward and rearward cup-like, disc-shaped end caps 74 and 76 respectively, are partially sleeved by the opposite ends of body 72.

End caps 74 and 76 are preferably fabricated from light-weight metal or plastic and are fixed to body 72 as by screws 78, or the like.

Figure 14:
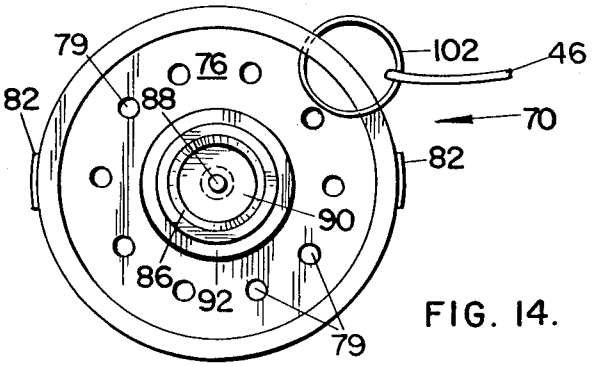
FIG. 14 is an end elevational view of the article carrying missile as seen from the right of FIG. 9.

A plurality of spaced circumferentially disposed openings 79, best seen in FIG. 14, are provided in the base of end cap 79, for purposes to appear.

A clear, transparent, tubular sleeve 80 is sleeved on body 72 in snug-fitting manner and extends longitudinally between end caps 74 and 76.

Sleeve 80 comprises a pair of identical, semi-circular, upper and lower mating half-parts 80A and 80B, respectively, which are releasably joined together along their mating edges by a pair of spaced parallel, longitudinally-extending, frangible strips 82 secured to the half-parts at each side of the sleeve as by adhesive, or the like, not shown.

Strips 82 are frangible or rupturable to permit separation of the half-parts 80A and 80B, for purposes to appear.

A pair of rows of spaced perforations 84 are provided in each half-part 80A and 80B to lighten the weight of the half-parts, when same is in flight, and to permit entry of water, when the missile is in water.

A tubular metal or plastic handle 86 is fixed centrally of rearward end cap 76 as by a screw 88 which extends through the end cap and is threadedly engaged in a base wall 90 of the handle, the handle extending horizontally outwardly from the end cap.

A resilient rubber or plastic hand grip 92 is sleeved on handle 86.

A nose 94, preferably fabricated from rubber or soft, resilient plastic, is fixed to the forward face of forward end cap 74 as by adhesive or the like, not shown.

Nose 94 is shaped in the form of a truncated cone which extends outwardly from forward end cap 74 and has a central bore 96 communicating with a central opening 98 extending through end cap 74, the bore 96 and opening 98 permitting the entry of water into the interior of missile 70 when same is in a body of water, for purposes to appear.

Figure 8:
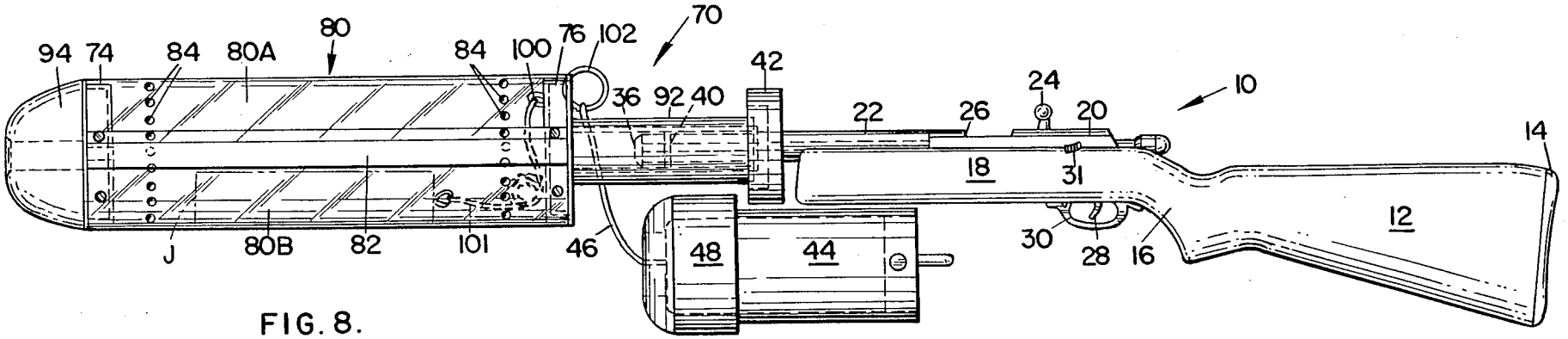
FIG. 8 is a rear elevational view of the launcher similar to FIG. 3 and having a missile in the form of an article carrier in place ready to be launched in lieu of a buoy.

Handle 86 of article carrier missile 70 may be grasped by hand and thrown, or the missile may be launched by launcher 10, in which case tubular handle 86 of the missile is sleeved on the muzzle 34 and barrel 22 of the launcher as shown in FIG. 8 and is launched when the launcher is fired or discharged.

The body 72 of the missile, being trough-shaped, acts as a receptacle, when transparent sleeve 80 is removed, to receive articles such as an inflatable life jacket J, or other articles such as an inflatable life ring, not shown, desired to be delivered to distant locations in water or in tall buildings or remote areas.

In the case of life jacket J, it is placed in body 72 of missile 70 in a folded or uninflated condition, as seen in FIGS. 8–11, and the sleeve is slid back over the body so as to enclose the body and its contents.

Figure 16:
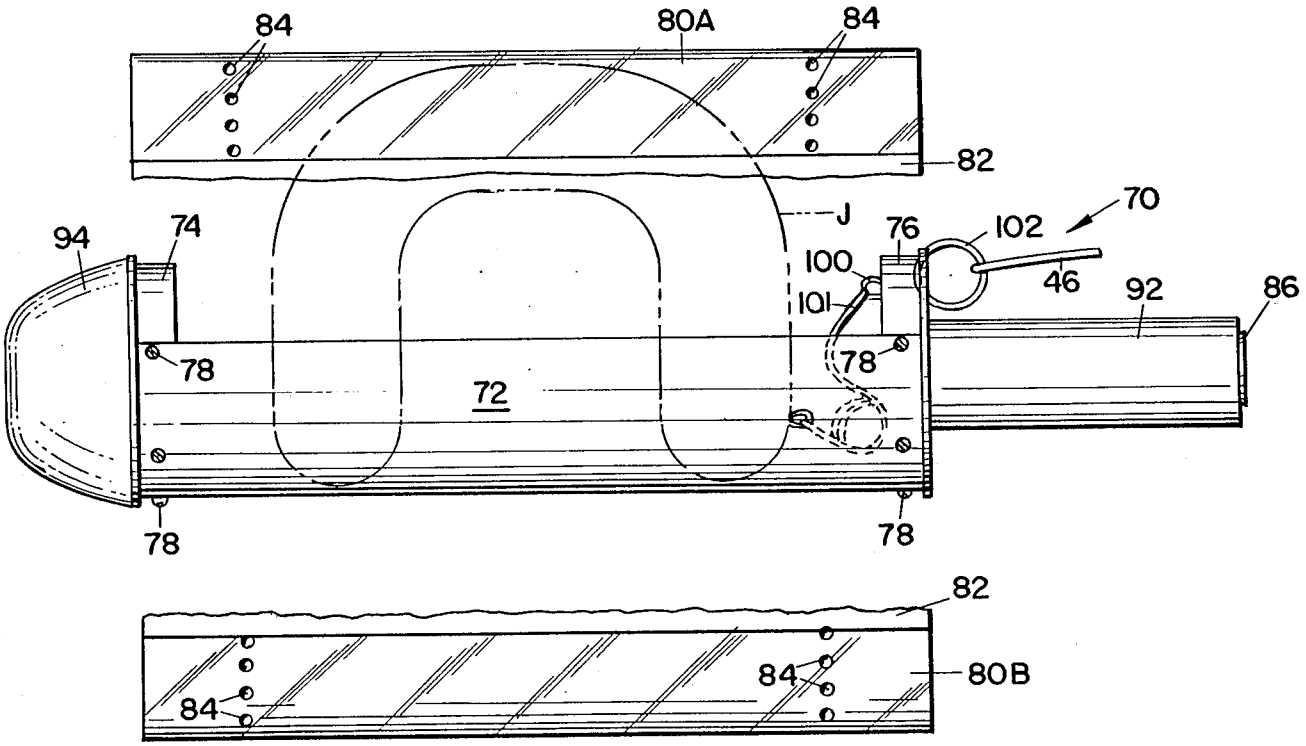
FIG. 16 is an exploded side elevational view of the article carrying missile after launching and showing the transparent sleeve thereof as ruptured upon the inflation of a horseshoe type life jacket carried by the missile and enclosed within the sleeve.
Figure 9:
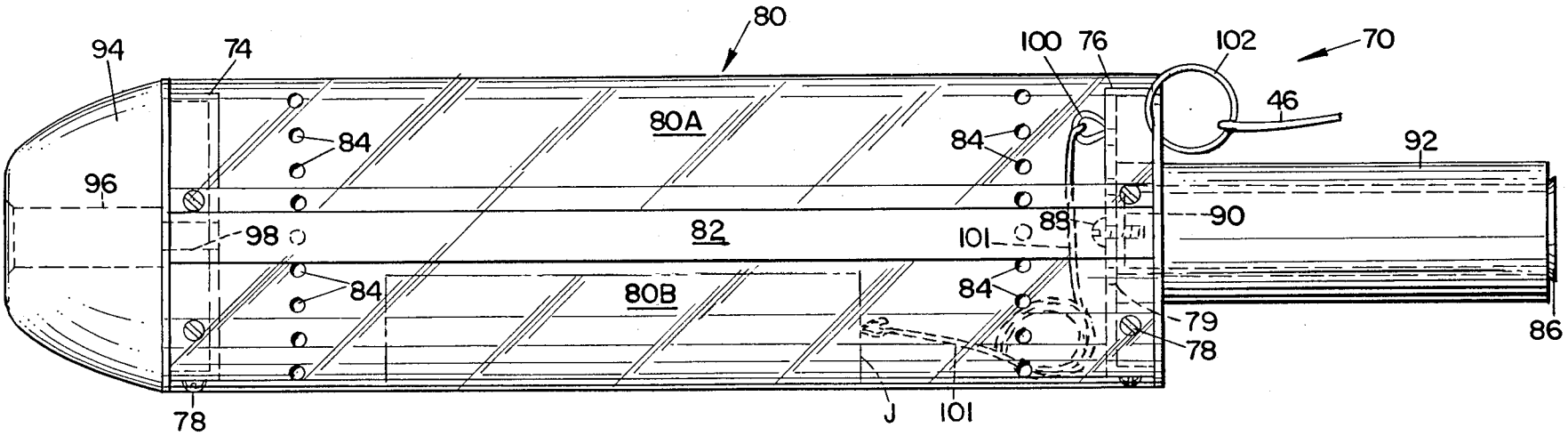
FIG. 9 is a front elevational view of the article carrying missile of FIG. 8.
Figure 10:
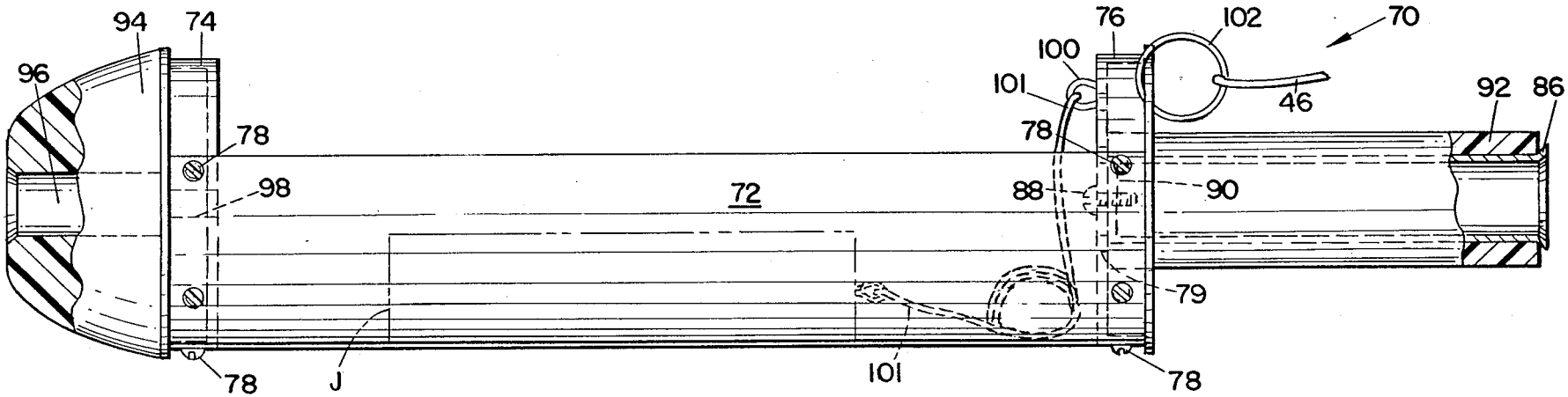
FIG. 10 is a front elevational view of the article carrying missile similar to FIG. 9 with the transparent sleeve thereof removed.
Figure 11:
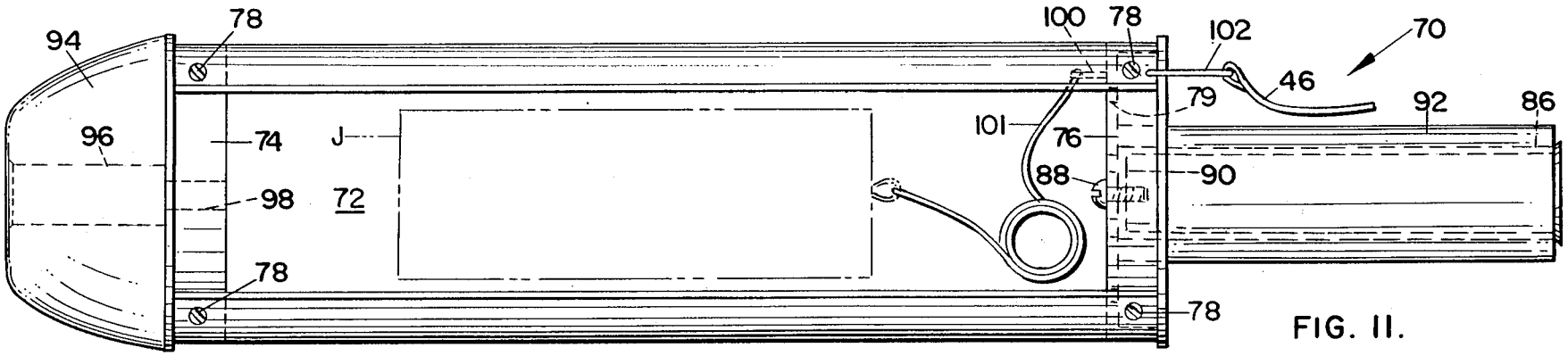
FIG. 11 is a top plan view of the article carrying missile of FIG. 10.
Figure 13:
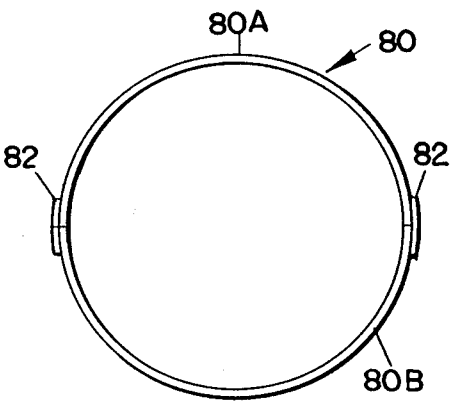
FIG. 13 is an end elevational view of the transparent sleeve of FIG. 12.
Figure 12:
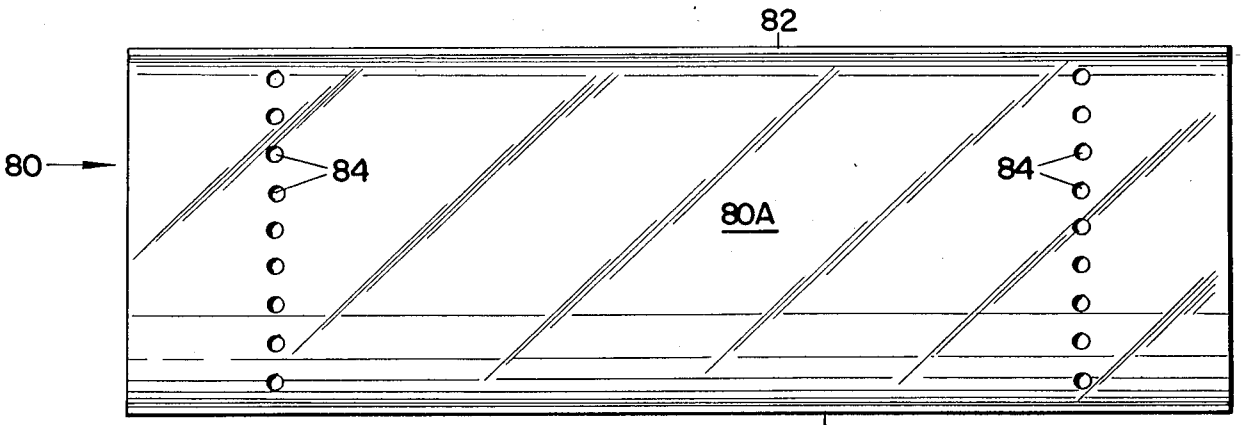
FIG. 12 is a top plan view of the transparent sleeve of the article carrying missile.
Figure 15:
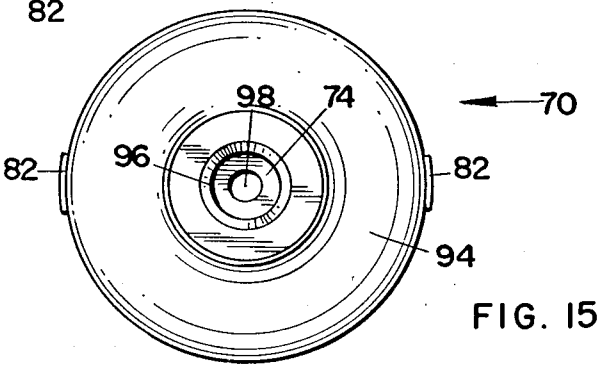
FIG. 15 is an end elevational view of the article carrying missile as seen from the left of FIG. 9.

Following launching by hand or by launcher 10, when missile 70 strikes the water the life jacket automatically inflates, as seen in FIG. 16, causing the strips 82 to rupture, allowing the sleeve half-parts 80A and 80B to separate whereupon the life jacket becomes accessible to the person being rescued.

Since the missile is quite lightweight and its nose and handle grip are fabricated from soft, resilient material, it causes little or no damage if it strikes a person or object.

A clip 100 is provided on the inner end of cap 76 of missile 70 to facilitate the securement of the end of a line 101 extending from the end cap to life jacket J, whereby the missile, after inflation of the life jacket, remains attached to the life Jacket and acts as a sea anchor for the life jacket with the opening 96 in nose 94, opening 98 in end cap 74, openings 79 in end cap 76 and openings 84 in sleeve 80 permitting the rapid entry of water into the missile causing it to sink quickly.

A ring 102 fixed to rearward end cap 76 of the missile is provided for securing an end of line 46 to the missile, thereby connecting the missile to launcher 10 and permitting the recovery of the missile by hauling in on line 46.

I claim:

1. Rescue apparatus comprising a launcher, a missile, a supply of line mounted on the launcher, the launcher being a non-lethal firearm adapted to fire a blank round and having a barrel with a bore closed at its muzzle end, the muzzle end having gas ports therein, the missile being sleevable on the barrel and having means for connecting the line thereto whereby when the firearm is discharged gas escapes from the bore through the gas ports to propel the missile into space carrying the line therewith, the missile being a launchable and hand-grippable and throwable article-carrier including a body for carrying rescue items and a tubular handle on the body and a rupturable transparent tubular sleeve for confining the rescue items, the handle being sleevable on the launcher barrel for launching or alternatively being grippable and throwable by hand.

2. Rescue apparatus according to claim 1, wherein the sleeve consists of a pair of abuting mating half parts, the seam between the half parts being closed by frangible tape.

3. Rescue apparatus according to claim 1, wherein the body and tubular sleeve are provided with openings for permitting the entry of water into the missile interior when same is propelled into water, and wherein one of the rescue items is a life jacket automatically inflatable when the missile strikes the water and means connecting the life jacket to the body.

* * * * *